US006273195B1

(12) United States Patent
Hauck et al.

(10) Patent No.: US 6,273,195 B1
(45) Date of Patent: Aug. 14, 2001

(54) DOWNHOLE FLOW AND PRESSURE CONTROL VALVE FOR WELLS

(75) Inventors: Emil Hauck, Littleton; Henry A. Baski, Denver, both of CO (US)

(73) Assignee: Baski Water Instruments, Inc., Denver, CO (US)

( * ) Notice: Subject to any disclaimer, the term of this patent is extended or adjusted under 35 U.S.C. 154(b) by 0 days.

(21) Appl. No.: 09/388,325

(22) Filed: Sep. 1, 1999

(51) Int. Cl.[7] ..... E21B 33/12; E21B 33/127; E21B 34/10

(52) U.S. Cl. ..... 166/374; 166/387; 166/129; 166/320; 166/326

(58) Field of Search ..... 166/68, 68.5, 106, 166/129, 133, 183, 184, 185, 187, 188, 305.1, 319, 320, 326, 369, 374, 386, 387

(56) References Cited

U.S. PATENT DOCUMENTS

| | | | |
|---|---|---|---|
| 3,960,211 | 6/1976 | Hutchison et al. . | |
| 4,013,124 | 3/1977 | Hutchison et al. . | |
| 4,098,341 | 7/1978 | Lewis . | |
| 4,540,047 | 9/1985 | Akkerman . | |
| 4,545,433 | * 10/1985 | Wambaugh | 166/105 |
| 4,577,696 | 3/1986 | Suman . | |
| 4,580,632 | 4/1986 | Reardon . | |
| 4,640,351 | 2/1987 | Clifton . | |
| 4,823,882 | 4/1989 | Stokley et al. . | |
| 4,834,176 | 5/1989 | Renfroe, Jr. . | |
| 5,316,081 | 5/1994 | Baski et al. . | |
| 5,778,982 | 7/1998 | Hauck et al. . | |

OTHER PUBLICATIONS

Valtek brochure, Valtek International Headquarters, Springville, UT, 1992.

* cited by examiner

*Primary Examiner*—David Bagnell
*Assistant Examiner*—Jennifer M. Hawkins
(74) *Attorney, Agent, or Firm*—Stephen A. Gratton

(57) ABSTRACT

A flow and pressure control valve for injecting a fluid into a well, or for pumping the fluid out of the well, includes an outer housing, a mandrel within the outer housing, and a pressure element attached to the mandrel. The pressure element can be pressurized to move radially inward to constrict a longitudinally extending flow passage in the valve between the mandrel and the outer housing. In addition, the mandrel includes annular orifices, and channel segments along the outside diameter thereof, which form tortuous and circumferential flow paths through the valve. The annular orifices and channel segments are constructed to provide a desired frictional head loss, and to control the pressure and flow rate of the injected fluid to prevent cavitation and cascading. Pressurization of the pressure element can also be controlled to vary the tortuous flow path through the flow passage, or to seal the flow passage. In addition to controlling fluid flow in wells, the valve can also be used in other piping systems including above ground systems.

26 Claims, 14 Drawing Sheets

68
60
66
94
70
56
64
62
54B
76B
48
4A
44
4A
42
40
4B
58
46
4B
76A
50
54A
52

74
80
110
154
72
138
112
134
126
128
132
136
112
164
156
114
114
130
120
116
118
92
84
94
106
108
142
140
44
90
98
144
100
124
122
160
102
158
5-5
7-7
156
72
102
122
160
158
148
6-6
90
44
146
104
108
150
152
106
86
82
88
94
96
78
74

90
108
92
136
144
114
92
120
118
74
124
116
166
122
92
164
136
126
128
132
160
72
116
156
160
126
128
130
132
148
146
98
100
102
104

90
136
90
114
120
100
118
116
92
124
102
120
122
10
11
11
10

DOWNHOLE FLOW AND PRESSURE CONTROL VALVE FOR WELLS

FIELD OF THE INVENTION

This invention relates to generally to the control of fluid flow in piping systems. More specifically, this invention relates to control valves and systems for controlling the flow direction, flow rate and flow pressure of a fluid in a piping system, such as a subterranean well.

BACKGROUND OF THE INVENTION

One type of valve used to control fluid flow in subterranean wells is known as an inflatable packer. In its simplest form a packer valve includes a pressure element adapted to sealingly engage, or disengage, a conduit of the well, such as a pipe or bore hole, to prevent, or to allow, fluid flow through the conduit. This allows a portion of a well to be isolated for sampling, flow testing, cementing, and other operations.

Inflatable packers can also include an internal mandrel configured as a conduit for pumping fluids out of the well, or for injecting fluids into the well. One application in which water is injected into a water well is known as Aquifer Storage and Recovery (ASR). Recharge water wells are used in ASR programs to assist communities during times of peak water demand. The ASR process involves injecting treated water through recharge wells into under ground aquifers during low-demand time periods, such as the winter months. The treated water can then be recovered using the recharge wells during high-demand time periods, such as the summer months.

A packer valve configured to control flow and pressure during injection of a fluid into a well is disclosed in U.S. Pat. No. 5,316,081 to Baski et al., entitled "Flow And Pressure Control Packer Valve". FIG. 1 from the above patent illustrates the prior art control valve 10 within a well 12. The control valve 10 is in fluid communication with a submersible pump 14 powered by a motor 16. In addition, the control valve 10 is in flow communication with a pump pipe 18 and with surface piping 20.

FIGS. 2A and 2B illustrate the operation of the control valve 10 during injection of water into the well 12. In FIG. 2A an inflatable element 22 of the valve 10 can be deflated to allow water injection from the surface, as indicated by flow arrows 24. The water is injected through a sand trap 28, and into an annular area 30 located between the uninflated surface of the inflatable element 22, and the inside diameter of an external housing 32 of the valve 10. The external housing 32 also includes a series of annular grooves 34 formed on the inside diameter thereof. The annular grooves 34 are configured to increase a frictional pressure loss through the valve 10 during injection, so that the injected water does not cascade and cavitate as it flows through the annular area 30 into the well 12. The annular grooves 34 can be configured to provide a desired frictional pressure loss, and thus a desired fluid pressure within the annular area 30. In addition, the inflatable element 22 can be pressurized to partially expand into the annular area 30, increasing pressure loss and reducing (controlling) flow through the valve.

In FIG. 2B, inflation of the inflatable element 22 seals the annular area 30 so that water cannot be injected into the well 12. However in this mode, water can be pumped from the well 12 through the check valve 26, and through an internal mandrel 36 of the valve 10 to the surface, as indicated by flow arrows 38.

The prior art control valve 10 is effective for controlling flow direction and fluid pressure of a fluid during injection into the well 12. However, one shortcoming of the valve 10 is that it is expensive to manufacture. In particular, the annular grooves 34 are difficult to machine on the inside diameter of the external housing 32. Typically, the grooves 34 must be machined on relatively short lengths of pipe, which must then be welded together to produce an external housing 32 with the required length.

The present invention is directed to a control valve that can also be utilized to control the flow direction and fluid pressure of a fluid during injection into a well. However, the control valve of the invention can be more easily manufactured, made with fewer parts, and is more effective in controlling fluid pressure over a wider range of well sizes than prior art control valves. The present invention is also more dependable, being much more difficult to sand lock, and not having exposed inflation tubes to break or malfunction.

SUMMARY OF THE INVENTION

In accordance with the present invention, an improved flow and pressure control valve is provided. In an illustrative embodiment the valve is configured for controlling fluid flow in a subterranean well. However, the valve can also be used to control fluid flow in any piping system, including above ground systems. Also provided are an improved well system that includes the control valve, and an improved method for injecting fluids into wells performed using the control valve.

The control valve can be used in a pumping mode to control the flow direction of a fluid during pumping of the fluid from the well. The control valve can also be used in an injection mode to control the flow direction, flow rate and flow pressure of the fluid during injection of the fluid into the well. In the injection mode, the valve is constructed to produce a frictional pressure loss as the fluid flows through the valve. The frictional pressure loss can be adjusted by control of a pressure element of the valve from the surface, to provide a desired flow rate and flow pressure in the fluid, and to prevent cavitation and cascading of the fluid.

The control valve includes an outer housing and an elongated mandrel located within the outer housing. The mandrel forms a conduit in flow communication with surface piping at an uphole end of the valve, and in flow communication with a submersible pump at a downhole end of the valve. For submersible pump applications, the mandrel includes a check valve proximate to the downhole end of the valve. During the pumping mode, fluid can be directed through the check valve, and through the mandrel to the surface piping. The control valve can also be used with turbine pumps, rather than submersible pumps, or without pumps, for control of injection only.

The control valve also includes the pressure element, which is connected to the inside diameter of the outer housing, and an annular flow passage located between the pressure element and an outside diameter of the mandrel. The pressure element comprises a multi-ply, vulcanized elastomeric tube, reinforced with strands of a reinforcing material, such as synthetic cords of polyester, aramid, nylon, or rayon; or steel cables. The pressure element is configured to seal the flow passage during the pumping mode, or alternately to vary an area of the flow passage during the injection mode.

A pressure chamber proximate to the uphole end of the valve contains a pressurized fluid for pressurizing the pressure element. The pressure chamber is controlled by gas pressure from the surface, and is in flow communication with an annular pressure passage located between the outer housing and the pressure element. A longitudinally extending vent tube is attached to the outer housing within the pressure passage, and includes vent holes for equalizing fluid pressure applied along the length of the pressure element, preventing inflation fluid from being trapped in the pressure passage.

The flow passage is in flow communication with the mandrel via radial flow orifices formed through the sidewall of the mandrel. The flow passage is also in flow communication with the well via a discharge annulus between the outer housing and the mandrel. An orifice section of the mandrel includes annular orifices which comprise annular grooves on the outside diameter thereof, and channel elements which comprise u-shaped channels attached to the outside diameter thereof. The annular orifices and channel segments form a frictional surface, and provide tortuous, axial, and circumferential flow paths through the flow passage, during the injection mode. Also during the injection mode, the pressure element is pressurized to move radially inward towards the mandrel, to decrease the size of the flow passage, and increase the frictional loss of the fluid flowing through the flow passage. The channels force an outer circumference of the pressure element to stretch as the element moves inwards towards the mandrel. The magnitude of the frictional loss is a function of the size and shape of the annular orifices and channel segments, and of the pressure exerted by the pressure element against the fluid, which affects the flow passage size.

The pressure element also includes a shut off section for sealing flow between the mandrel and the flow passage during the pumping mode. The shut off section is located proximate to an uphole end of the mandrel, and upon application of a sufficient pressure sealingly engages the annular orifices on the outside diameter of the mandrel to prevent flow between the flow orifices in the mandrel, and the flow passage through the valve.

DETAILED DESCRIPTION OF THE PREFERRED EMBODIMENT

Figure 1:
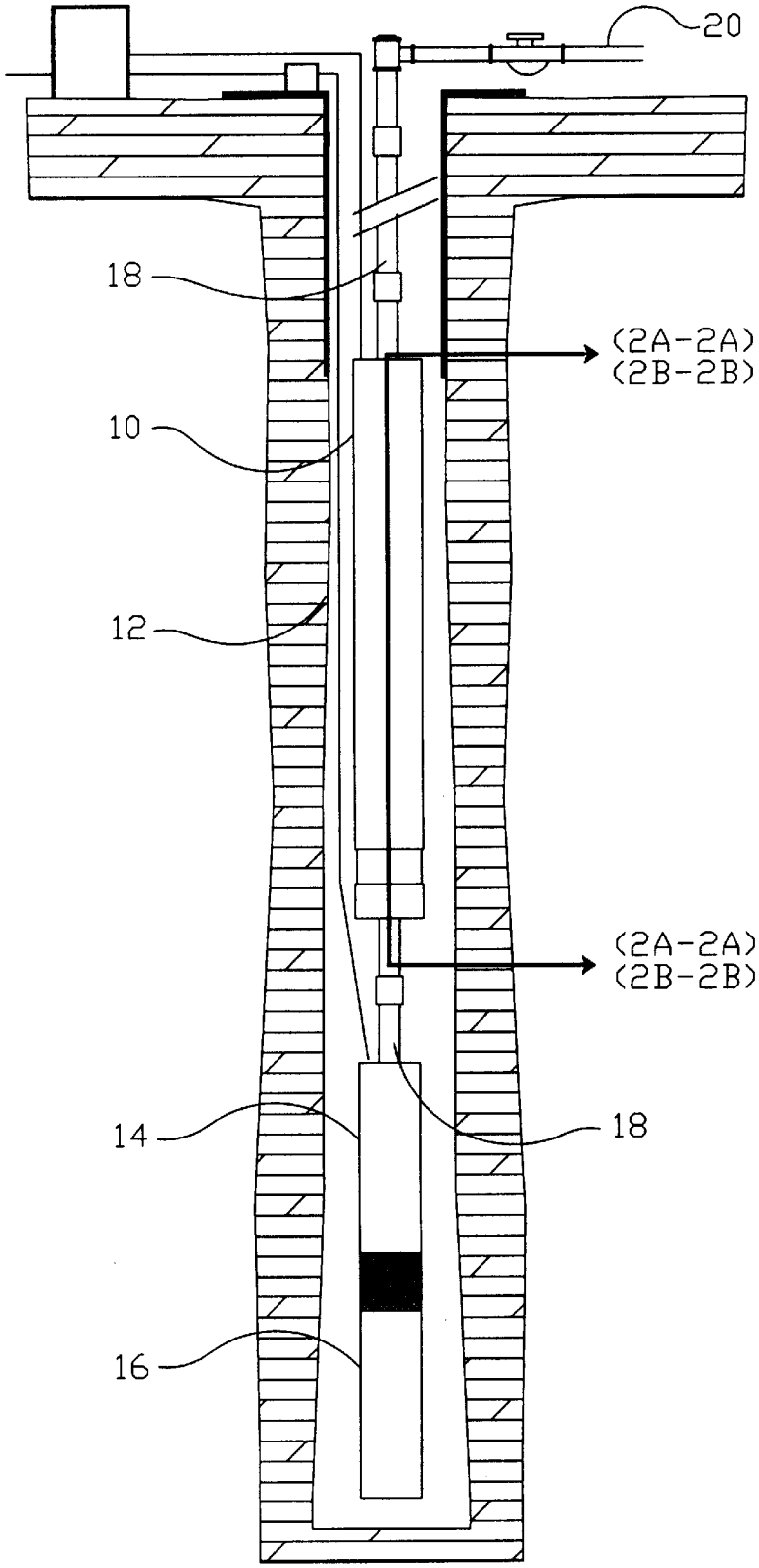
Fig.1 (Prior Art)
FIG. 1 is a schematic cross sectional view of a prior art flow and pressure control valve in a well.
Figure 2A:
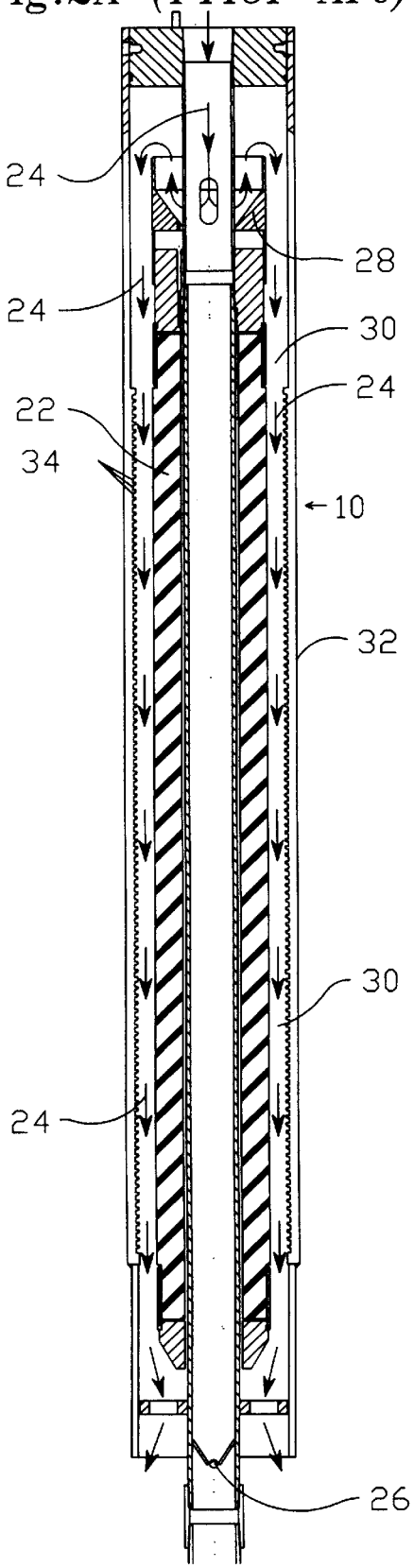
Fig.2A (Prior Art)
FIG. 2A is a cross sectional view of the prior art valve, taken along section line 2A—2A of FIG. 1, illustrating operation of the valve during injection of a fluid into the well.
Figure 2B:
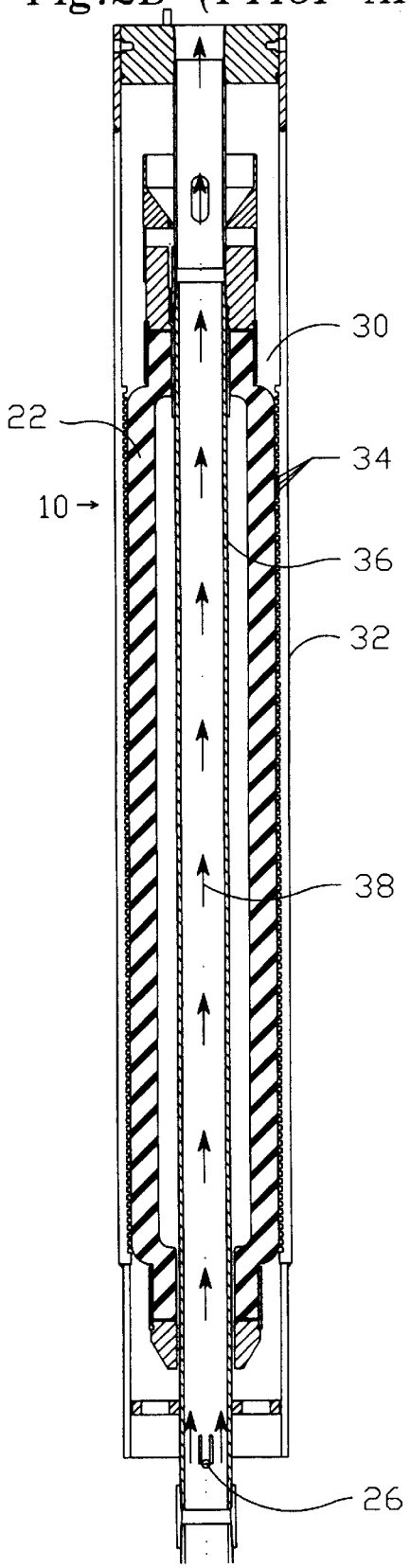
Fig.2B (Prior Art)
FIG. 2B is a cross sectional view of the prior art valve equivalent to FIG. 2A, illustrating operation of the valve during pumping of fluid from the well.
Figure 3:
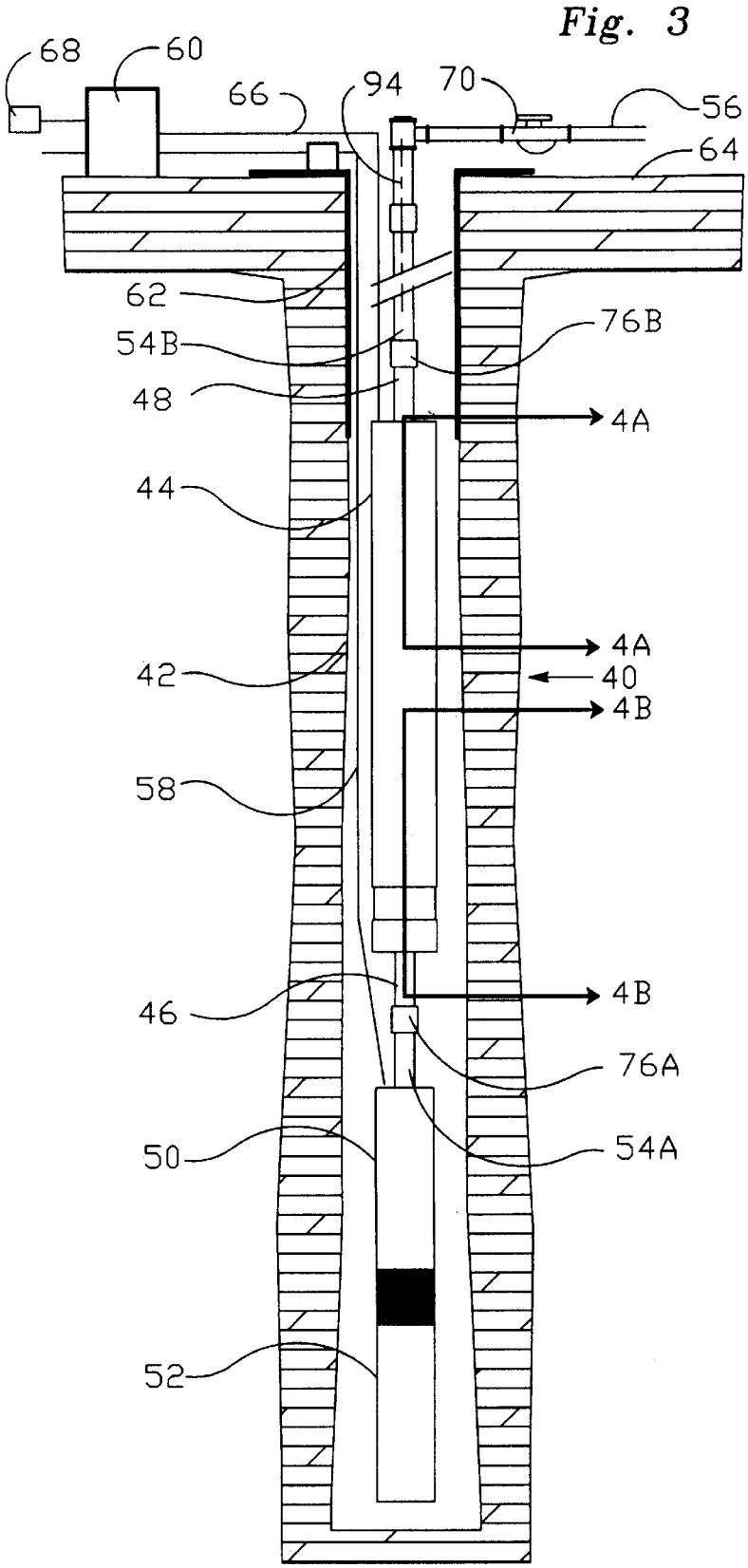
FIG. 3 is a schematic cross sectional view of a system that includes a flow and pressure control valve constructed in accordance with the invention.

Referring to FIG. 3, a system 40 for controlling fluid flow in a well 42 is illustrated. The well 42 includes a cylindrical well casing 62 that extends from a ground surface 64 into a geological formation at a required depth. This depth is typically from several hundred to several thousand feet. In the illustrative embodiment the well 42 is a pumping/recharge water well and the fluid being controlled is water. However, the system 40 can be configured to control other types of wells, and other fluids, such as oil or gas. In addition, the system 40 can be configured to control fluid flow in other piping systems including above ground systems.

The system 40 includes a control valve 44 constructed in accordance with the invention. As will be further explained, the control valve 44 is configured to control the flow direction of a fluid being pumped from the well 42 to the surface during a pumping mode of the control valve 44. The control valve 44 is also configured to control the flow direction, the flow rate, and the flow pressure of a fluid injected from the surface into the well 42 during an injection mode of the control valve 44. In the pumping mode, the fluid being pumped to the surface is water stored in the well, or in an underground aquifer in flow communication with the well 42. In the injection mode, the fluid being injected from the surface into the well 42 is water, which will be stored in the well and the aquifer until needed.

As also shown in FIG. 3, the control valve 44 includes a downhole end 46 in flow communication with a pump pipe 54A, and a submersible pump 50. The pump 50 is powered by a motor 52 in electrical communication with an electrical conduit 58, and a control panel 60 on the surface 64. The control valve 44 also includes an uphole end 48 in flow communication with a pump pipe 54B, a valve 70 and surface piping 56.

The control valve 44 is also in flow communication with a pressure conduit 66, controlled by the control panel 60, and coupled to a pressure source 68, such as an air compressor, nitrogen cylinder or bladder. The structure and function of the system 40 and control valve 44 will become more apparent as the description proceeds.

Figures 4A, 4B:
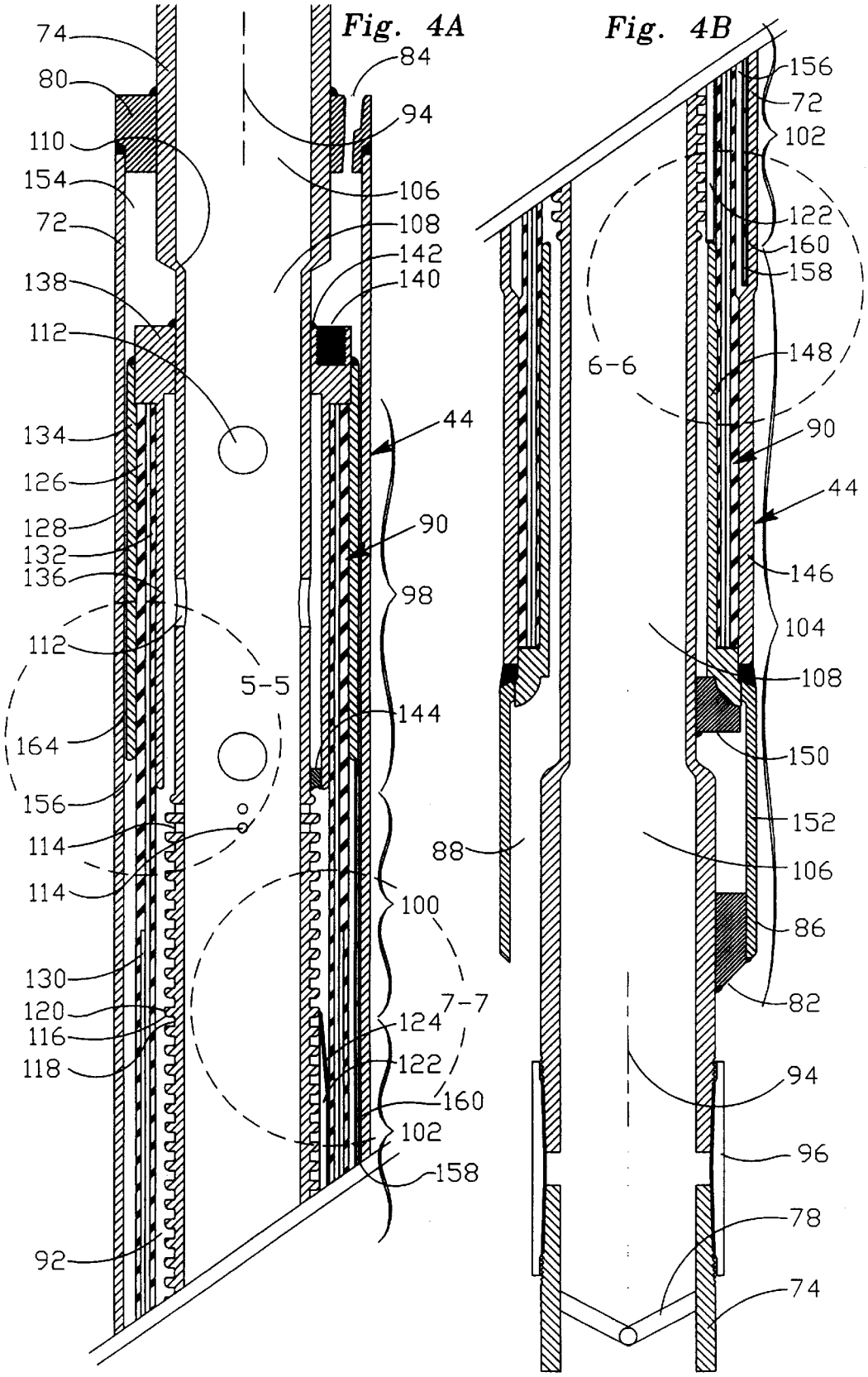
FIG. 4A is a cross sectional view of an uphole end of the control valve taken along section line 4A—4A of FIG. 3.
FIG. 4B is a cross sectional view of a down hole end of the control valve taken along section line 4B—4B of FIG. 3.

Referring to FIGS. 4A and 4B, the control valve 44 is illustrated in cross section. The control valve 44, broadly stated, includes: an outer housing 72; a mandrel 74 located within the outer housing 72 coincident to a longitudinal axis 94 of the valve 44; a flow passage 92 configured for selective flow communication with the mandrel 74 and the well 42; and a pressure element 90 for exerting a desired pressure on the fluid flowing in the flow passage 92 to control a flow path and a frictional flow pressure of the fluid.

In functional terms, the control valve 44 includes: a control section 98 for directing injection flow into a pressure passage 156; a shut off section 100 wherein the pressure element 90 controls fluid flow through the mandrel 74; an orifice section 102 wherein a tortuous flow path is provided for the fluid flowing in the flow passage 92; and a discharge section 104 wherein the flow passage 92 and the mandrel 74 are in flow communication with the well 42 (FIG. 3).

The outer housing 72 comprises an elongated tubular member having a diameter sufficient to enclose the mandrel 74 and the pressure element 90. The outer housing 72 can be formed of sections of metal tubing, or pipe, welded together to form a unitary structure having required internal and external features.

A donut shaped head member 80 attaches the outer housing 72 to the mandrel 74 at the uphole end 48 (FIG. 3) of the control valve 44. The head member 80 also seals the outer housing 72 from the well 42 at the uphole end 48 (FIG. 3) of the control valve 44. The head member 80 can be attached to the outer housing 72, and to the mandrel 74, using circumferential welds. The head member 80 includes a threaded gas port 84 configured for flow communication with the pressure conduit 66 (FIG. 3) and the pressure source 68 (FIG. 3) at the surface.

The outer housing 72 also includes a discharge segment 86 (FIG. 4B) proximate to the downhole end 46 (FIG. 3) of the valve 44. The discharge segment 86 is attached to a tail member 82 and to the mandrel 74 by welding. The discharge segment 86 includes an annular discharge port 88 in flow communication with the well 42 (FIG. 3).

Still referring to FIGS. 4A and 4B, the mandrel 74 comprises an elongated tubular conduit which is preferably formed of metal pipe or tubing. The mandrel 74 can comprise mating tubular segments that are welded or otherwise attached to form a unitary structure. The mandrel 74 has an inside diameter and an outside diameter, which can vary in size on different portions thereof along the length of the mandrel 74. For example, larger inside diameters 106 at either end of the mandrel 74, merge with smaller inside diameters 108 in the center of the mandrel 74, via smooth bell shaped transitions 110.

The mandrel 74 is in flow communication with the pump piping 54B (FIG. 3) at the uphole end 48 (FIG. 3) of the control valve 44. A coupling 76B (FIG. 3) attaches the mandrel 74 to the pump piping 54B (FIG. 3). In addition, the mandrel 74 is in flow communication with the pump piping 54A (FIG. 3) and with the pump 50 (FIG. 3), at the downhole end 46 (FIG. 3) of the control valve 44. A coupling 76A (FIG. 3) attaches the mandrel 74 to the pump 15 piping 54A (FIG. 3). The pump piping 54A (FIG. 3) also includes an internal check valve 78 proximate to the downhole end 46 (FIG. 3) of the control valve 44. A threaded coupling 96 (FIG. 4B) removably attaches the check valve 78 to the mandrel 74 such that the inside diameter of the mandrel 74 is in flow communication with the check valve 78.

The mandrel 74 includes a plurality of flow orifices 112 formed through the sidewalls thereof in the control section 98 of the valve 44. The flow orifices 112 are in flow communication with the flow passage 92 through the valve 44, and permit fluid to be injected from the surface into the flow passage 92 during the injection mode of the valve 44. The mandrel 74 also includes release orifices 114 in the shut off section 100 of the valve 44. The release orifices 114 aid in releasing the pressure element 90 from the outside diameter of the mandrel 74 during transition from the pumping mode to the injection mode, by allowing pressure from the injected fluid to move the pressure element 90 radially outward. The release orifices 114 also function as a sand drain.

The mandrel 74 also includes a plurality of annular orifices 116 formed on the outside diameter thereof. The annular orifices 116 comprise circumferential grooves formed on the outside diameter of the mandrel 74, in the shut off section 100, and in the orifice section 102 of the valve 44. The annular orifices 116 include trough portions 118 and tooth portions 120. Fluid injected from the surface through the flow passage 92 flows through the annular orifices 116 to the discharge port 88 (FIG. 4B). The annular orifices 116 provide a frictional surface and a tortuous flow path for fluid flowing through the flow passage 92. This frictional surface helps to support the column of fluid from the surface such that cavitation and cascading is minimized. In addition, the pressure element 90 operates in conjunction with the annular orifices 116 such that the frictional loss and flow pressure of the fluid flowing through the flow passage 92 can be controlled by fluid pressure exerted on the pressure element 90. The passage 92 comprises an annular gap between the orifice 116 and the element 90.

In the shut off section 100, the pressure element 90, upon application of a sufficient pressure, can be pressed against the outside diameter of the mandrel 74 to seal the annular orifices 116. In the pumping mode of the valve 44 actuation of the pressure element 90 in the shut off section 100 prevents fluid communication between the flow orifices 112 in the mandrel and the flow passage 92. By way of example, the shut off section 100 can be from about 6 inches to 12 inches long, depending on design flow rates and the size of the flow passage 92.

Figure 7:
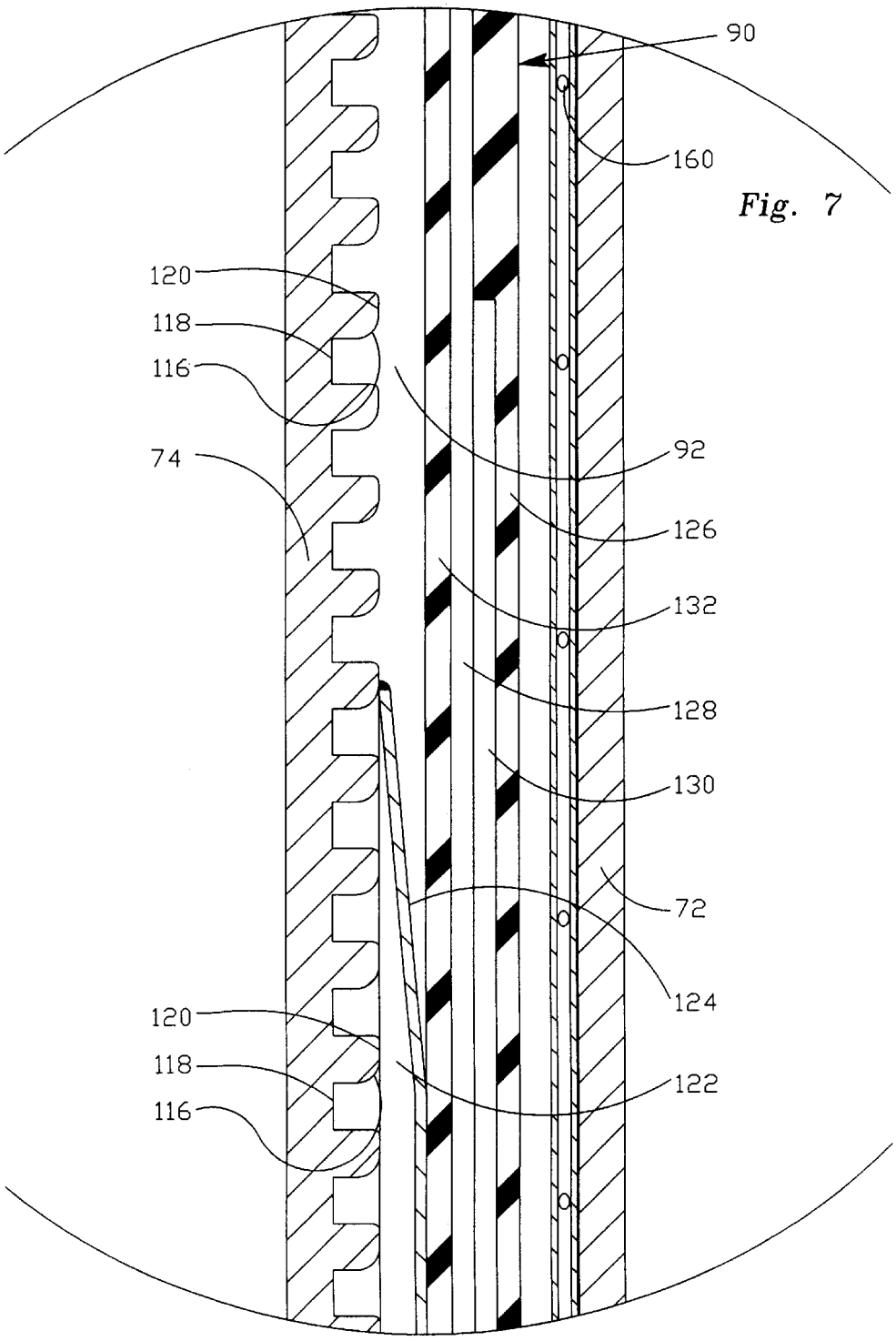
FIG. 7 is an enlarged segment of FIG. 4A taken along section line 7—7 and illustrating a channel segment of the control section.

The orifice section 102 also includes a plurality of radially-spaced, longitudinally-extending, generally u-shaped, channel elements 122 attached to the mandrel 74 in the orifice section 102. The channel elements 122 prevent the pressure element 90 from sealing the annular orifices 116 in the orifice section 102 during the injection mode of the valve 44. In addition, the channel elements 122 allow the pressure element 90 to deform into the spaces between the channel elements 122 in a manner to be hereinafter described, to provide additional control of the flow pressure in the flow passage 92. By way of example, the packer valve 44 can include from four to sixteen channel elements 122, that are equally radially spaced around the outside diameter of the mandrel 74. As shown in FIG. 7, each channel element 122 includes a tapered segment 124 to provide a smooth transition for fluid flowing in the flow passage 92 into the orifice section 102 of the valve 44, and to prevent damage to the element 90.

Frictional head loss through the orifice section 102 is a function of the number, placement and size of the channel elements 122. By way of example, the channel elements 122 can be from five inches to ten inches long per one hundred feet of water head.

Still referring to FIGS. 4A and 4B, the pressure element 90 comprises a tube 126, reinforcing layers 128, 130, and a cover 132. The tube 126, reinforcing layers 128, 130 and cover 132 are vulcanized to form a unitary structure. In addition, as will be more fully described, the reinforcing layers 128, 130 can be constructed to provide a higher stretch pressure at the downhole end 46 (FIG. 3), relative to the uphole end 48 (FIG. 3) of the valve 44.

Figure 5:
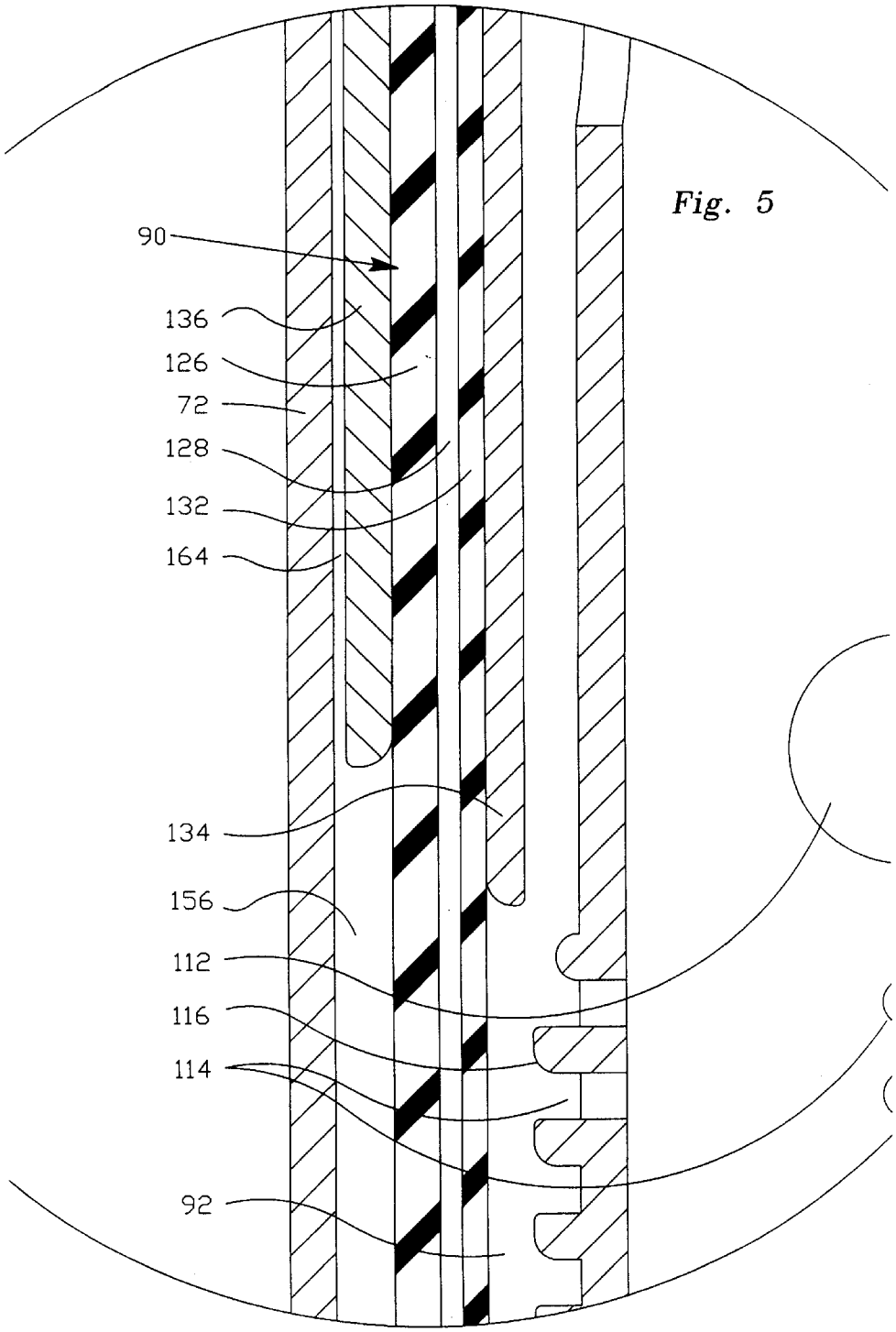
FIG. 5 is an enlarged segment of FIG. 4A taken along section line 5—5 and illustrating a control section of the control valve.

As shown in FIG. 4A, an upper crimp collar 134 and an upper barb 136 secure the pressure element 90 to the mandrel 74 at the up hole end 48 of the valve 44. A spacer element 144 attaches the barb 136 to the outside diameter of the mandrel 74. An insert element 138 is attached to the crimp collar 134 and to the barb 136 and to the outside diameter of the mandrel 74. The insert element 138 includes a threaded tension port 140 that allows the pressure element 90 to be tensioned prior to attaching the insert element 138 to the mandrel 74 by making weld 142. The pre tensioning of the pressure element 90 helps to reduce migration of the pressure element 90 towards the down hole end 46 of the valve during assembly and operation of the element 90 during injection flow control. FIG. 5 illustrates the pressure element 90 and its attachment to the crimp collar 134 and to the barb 136.

Figure 6:
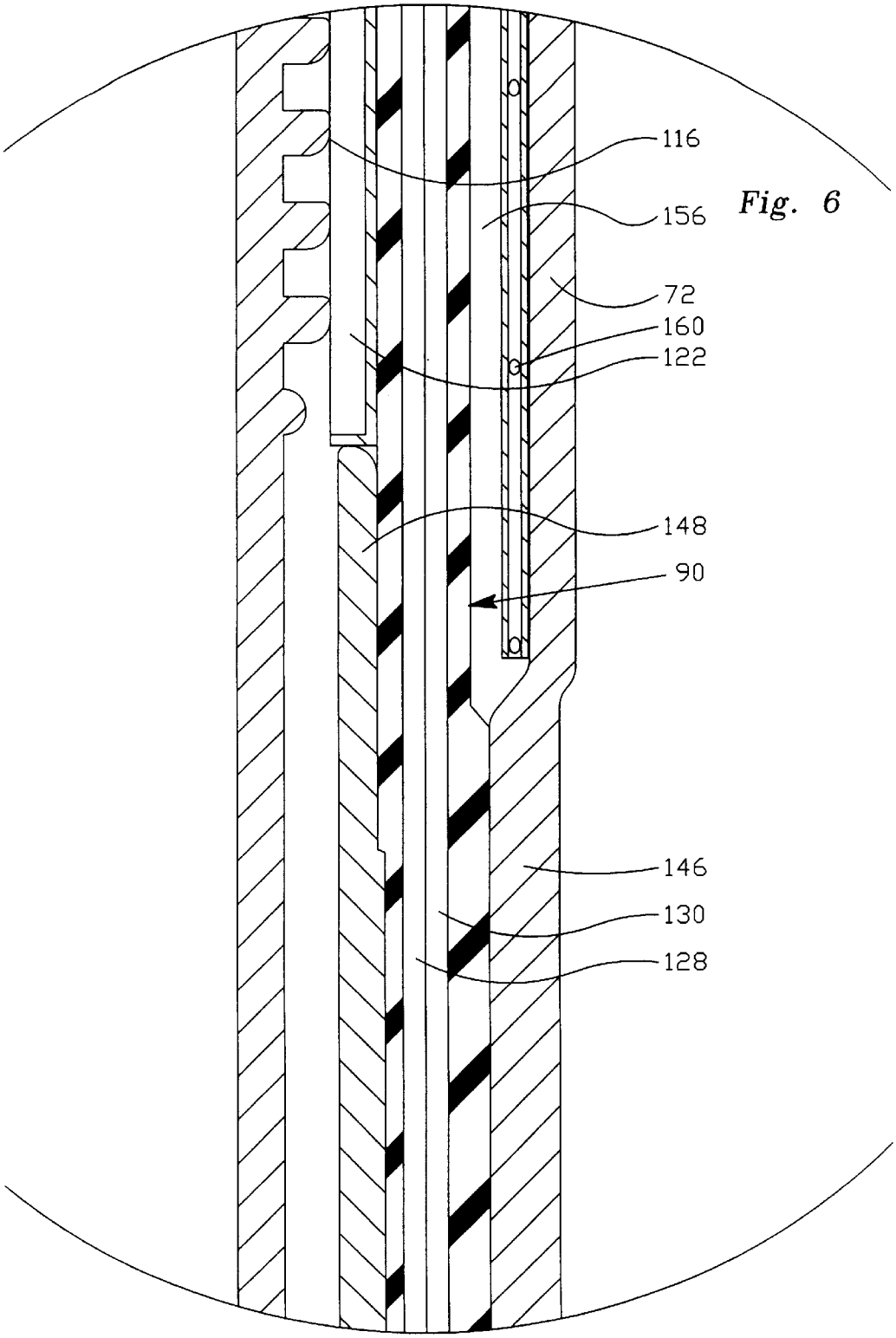
FIG. 6 is an enlarged segment of FIG. 4B taken along section line 6—6 and illustrating a crimped portion of an pressure element of the control valve.

As shown in FIG. 4B, a lower crimp collar 146 and a lower barb 148 secure the pressure element 90 to the outside diameter of the mandrel 74 at the down hole end 46 of the valve. The lower crimp collar 146 is formed as an extension of the outer housing 72. A spacer element 150 attaches the lower barb 148 to the outside diameter of the mandrel 74. In addition, the lower barb 148 extends beyond the upper end of the lower crimp collar 146 to allow portions of the pressure element 90 which is dragged to the down hole end 46 of the valve 44 during assembly and injection control to migrate to the area near the interface of the outer housing 72 and the lower crimp collar 146. Also in this area a tail section 152 of the outer housing 72 attaches to the tail member 82 and defines the discharge port 88 for flow passage 92. As shown in FIG. 6 the lower barb 148 is in physical contact with, and welded to, the channel elements 122 in the orifice section 102 of the valve 44.

As also shown in FIGS. 4A and 4B, a pressure chamber 154 is located near the up hole end 48 of the valve 44 between the outer housing 72 and the mandrel 74. The pressure chamber 154 is configured to contain a pressurized fluid, such as water, and to apply the pressurized fluid to the pressure element 90 via a connecting passage 164 and a pressure passage 156 formed along the inside diameter of the outer housing 72. The pressure chamber 154 is in flow communication with the pressure port 84 and with the pressure conduit 66 (FIG. 3) to the surface. A desired pressure is exerted on the pressure element 90 by applying gas pressure through the pressure conduit 66 to the fluid contained in the pressure chamber 154. The pressurized fluid then flows through the connecting passage 164 to the pressure passage 156 and moves the pressure element 90 radially inward to restrict fluid flowing in the flow passage 92 during the injection mode. Liquid actuation of the pressure element 90 eliminates gas permeation into the pressure element 90. In addition, liquid actuation provides a dampening effect on the pressure element 90 and reduces potential flutter during high injection rates. Also, because the pressure chamber 154 is incorporated into the flow control valve 44, the pressurized fluid cannot fill the pressure passage 156 above the static pumping, or injection water levels/pressures. This situation could apply pressure to the pressure element 90 and adversely affect its operation particularly at low water levels.

A vent tube 158 can be located proximate the inside diameter of the outer housing 72 to extend along the length of the pressure element 90. The vent tube 158 includes vent holes 160 which equalize pressure across the length of the pressure element 90. The vent holes 160 also prevent pressure from the shut off section 100 of the valve 44 from being trapped in pressure passage 156. Such a situation can occur during the transition from the pumping mode to the injection mode. In this case the column of water in the flow passage 92 the valve 44 can trap higher pressure water near the down hole end 46 of the valve 44 before it can be relieved. This can make the valve 44 open more slowly during the injection mode. The vent tube 158 thus performs both a pressurizing and a de pressurizing function. FIG. 6 clearly illustrate the vent tube 158 and the vent holes 160.

Operation

Figure 8:
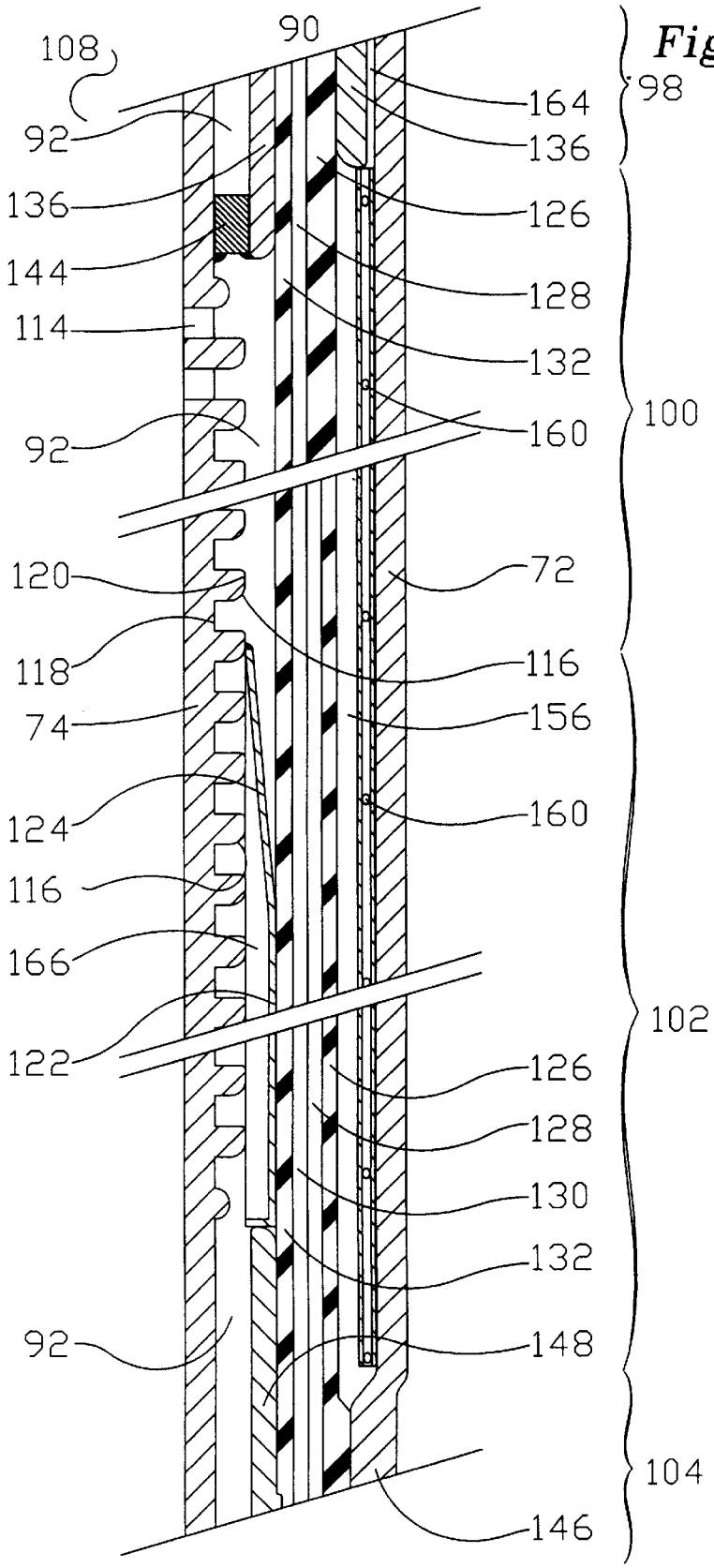
FIG. 8 is a longitudinal cross sectional view of the valve during the injection mode of the control valve.
Figure 9:
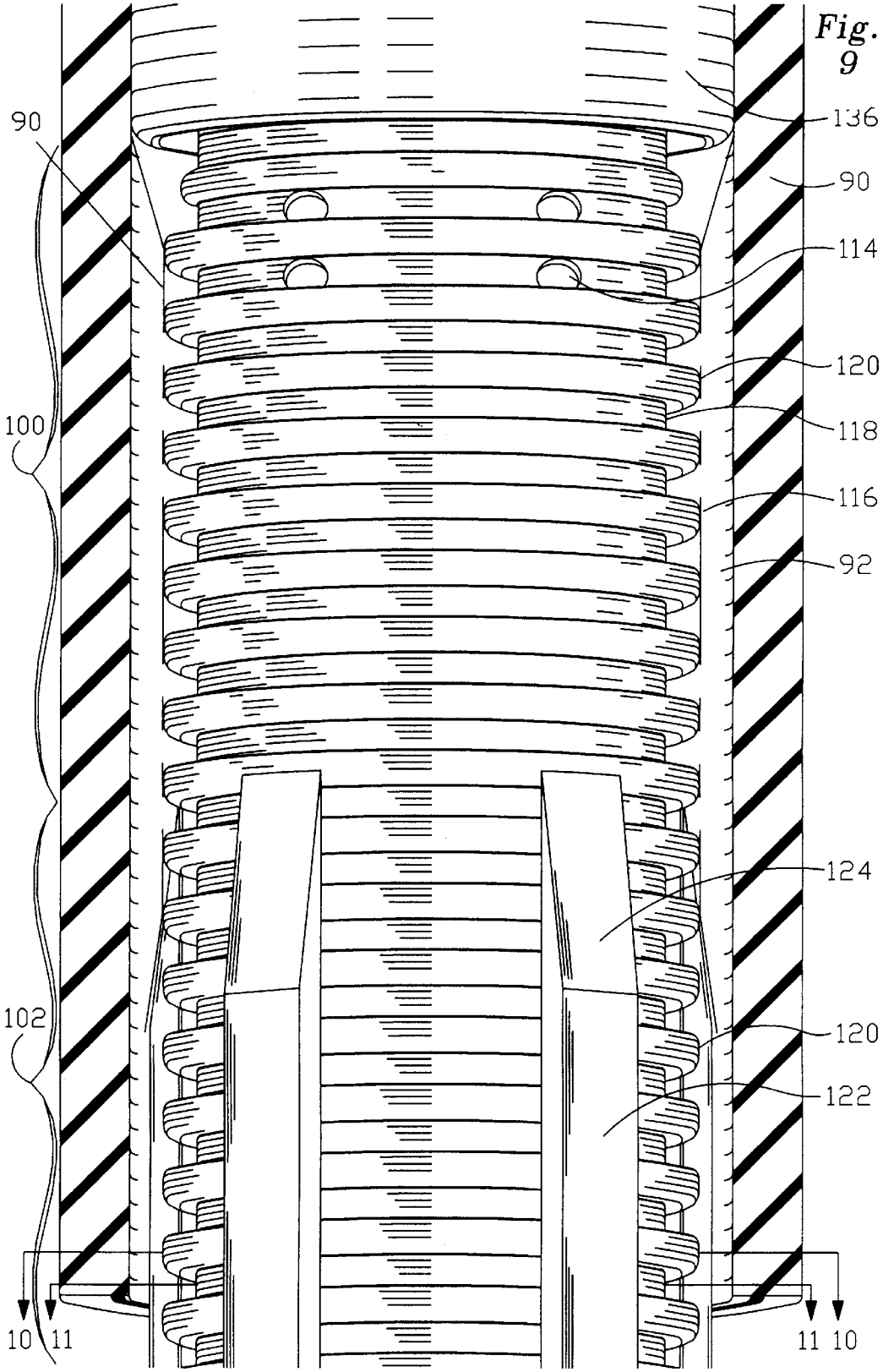
FIG. 9 is an enlarged schematic view of a portion of the control section during the injection mode of the control valve.

Referring to FIGS. 8 and 9, the control valve 44 is illustrated during the injection mode wherein fluid is injected from the surface into the well 42. For simplicity, the pressure element 90 is shown as a unitary structure in FIG. 9.

As shown in FIG. 8, in the control section 98 of the valve 44, there is fluid communication between the inside diameter 108 of the mandrel 74 and the flow passage 92. This allows water to be injected through the mandrel 74 and through the flow orifices 112 (FIG. 4A) into the flow passage 92.

As shown in FIGS. 8 and 9, in the shut off section 100 of the valve 44, the pressure on the pressure element 90 is controlled such that the flow passage 92 is open.

As also shown in FIGS. 8 and 9, in the orifice section 102, the tapered segments 124 of the channel elements 122 allow a smooth transition for fluid flow through the flow passage 92 and into the orifice section 102 and prevents damage to the element. In addition, the water flows through the flow passage 92, and through the annular orifices 116 in the orifice section 102. Further, the water flows through the u-shaped middle portions 166 (FIG. 11) of the channel elements 122.

As shown in FIG. 8, in the discharge section 104 of the valve 44, the water can flow through the flow passage 92 and through the discharge port 88 (FIG. 4B) into the well 42.

Figure 10:
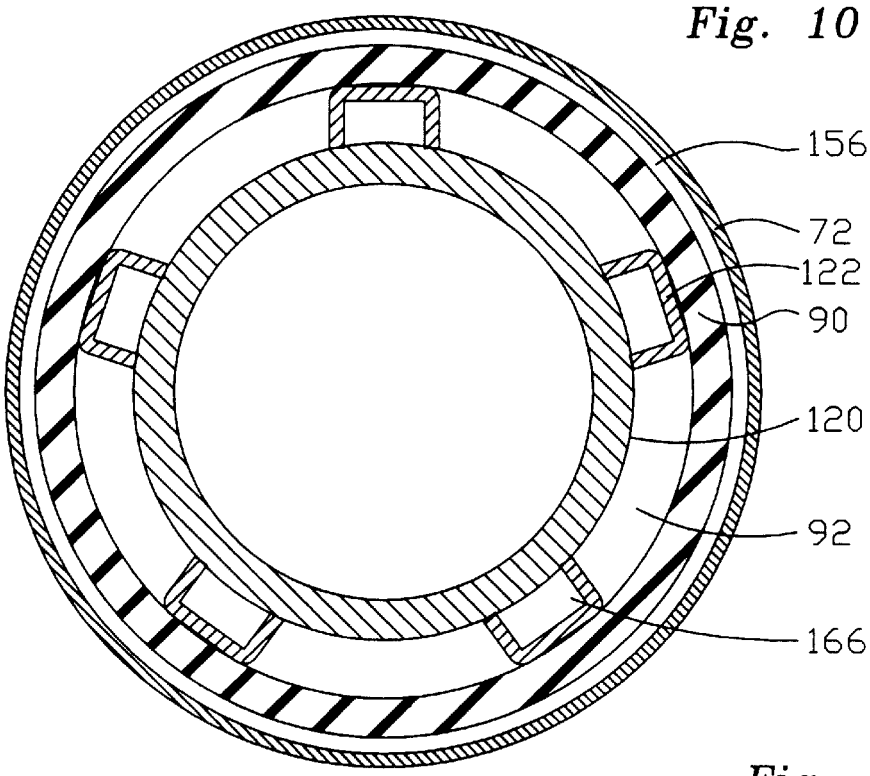
FIG. 10 is a cross sectional view taken along section line 10—10 of FIG. 9.
Figure 11:
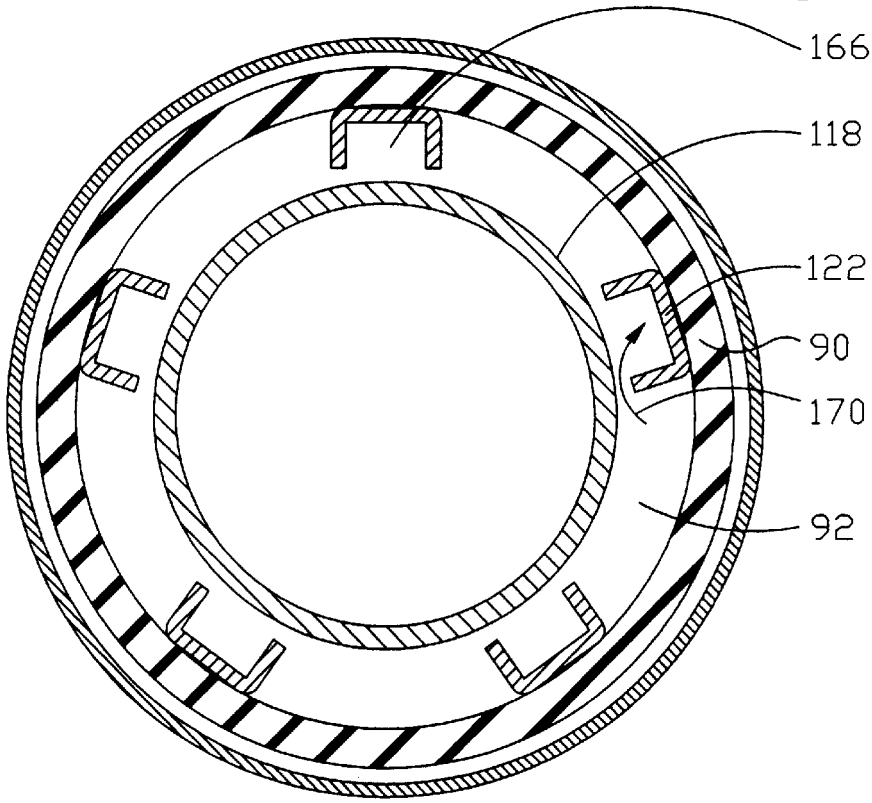
FIG. 11 is a cross sectional view taken along section line 11—11 of FIG. 9.

Referring to FIGS. 10 and 11, lateral cross sectional configurations of the valve 44 in the orifice section 102 during the injection mode are illustrated. FIG. 10 is a cross section through a tooth portion 120 of an annular orifice 116. FIG. 11 is a cross section through a trough portion 118 of an annular orifice 116. For simplicity, the pressure element 90 is shown as a unitary structure in FIGS. 10 and 11.

As indicated by flow arrow 170 in FIG. 11, the water in the flow passage 92 can flow into and through u-shaped middle portions 166 of the channel elements 122. Also in the orifice section 102, the pressure element 90 is biased by fluid pressure in the pressure passage 156 to press against the water in the flow passage 92. The frictional pressure loss through the orifice section 102 is a function of the gap in the flow passage 92.

Figure 12:
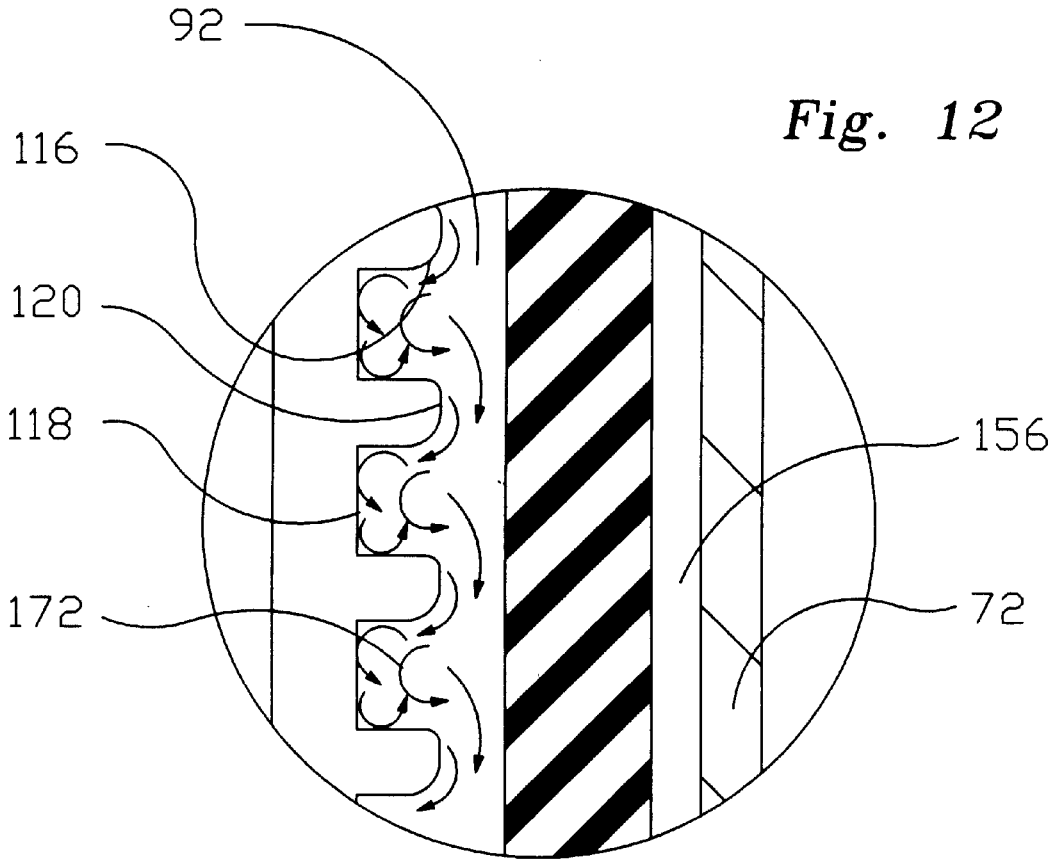
FIG. 12 is a cross sectional view of the orifice rings and pressure element of the control valve illustrating fluid flow through the orifice rings during an injection mode of the control valve.

Referring to FIG. 12, flow of the water in the flow passage 92 is illustrated proximate to the annular orifices 116. As indicated by flow arrows 172, the water follows a tortuous path through the annular orifices 116. This tortuous path provides a frictional head loss during flow of the water through the flow passage 92. This frictional head loss is a function of the size, number and shape of the annular orifices 116, and of the gap distance formed by pressure exerted on the outside of pressure element 90.

Referring again to FIG. 9, during the pumping mode the pressure element 90 is actuated by fluid pressure in the pressure passage 156 to seal the shut off section 100 of the valve 44, as indicated by the phantom lines. In particular, the pressure element 90 the flow passage 92 from fluid communication with the flow orifices 112 (FIG. 4A). This permits water to be pumped by the pump 50 from the well 42 (FIG. 3) through the inside diameter 106 (FIG. 4A) of the mandrel 74 (FIG. 4A), and through the pump pipe 54B (FIG. 3) to the surface.

Design Parameters

FIGS. 13–17 illustrate design characteristics of the control valve 44.

Figure 13:
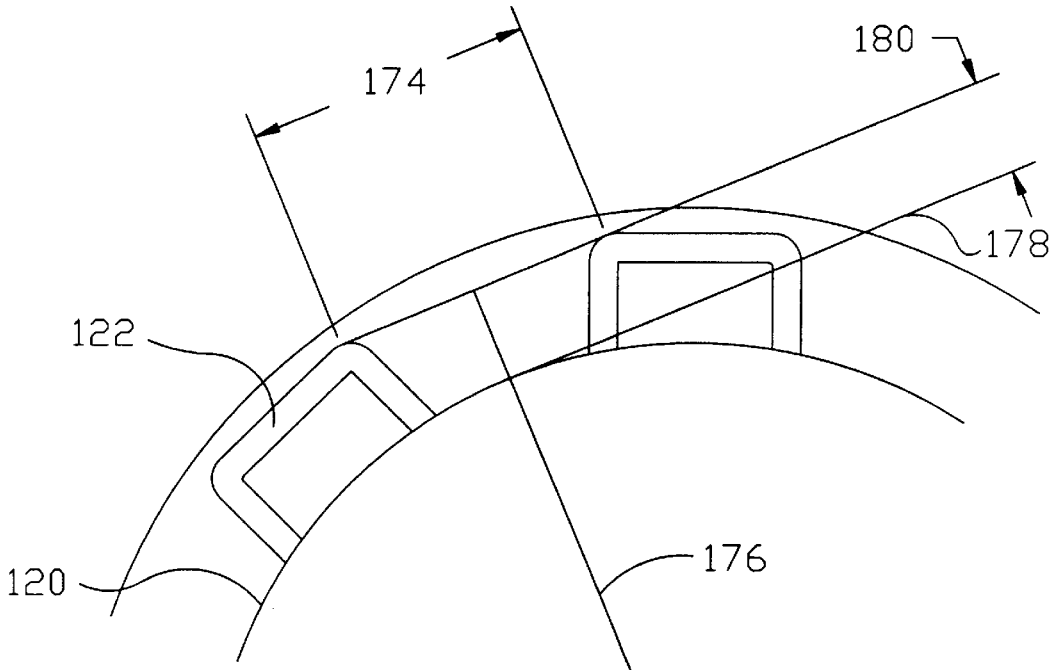
FIGS. 13 and 14 are schematic views illustrating design parameters of the channel segments of the valve.

Referring to FIG. 13, during design of the channel elements 122 there is a ratio of two lengths to consider. Initially, a channel cord 174 is drawn from corner to corner of two adjacent channel elements 122. A line 176 is then drawn from the center of the radius of curvature of the top of the tooth portion 120 of the channel elements 122, to the center of the channel chord 174. The segment of the line 176, which is of interest, extends from the intersection of the line 176 with a line 178 tangent to the radius of curvature of the tooth portion 120 to the midpoint of the channel chord 174. This segment is termed the chord height 180. The ratio of the channel chord 174 to the chord height 180 should be on the order of 4.7.

Figure 14:
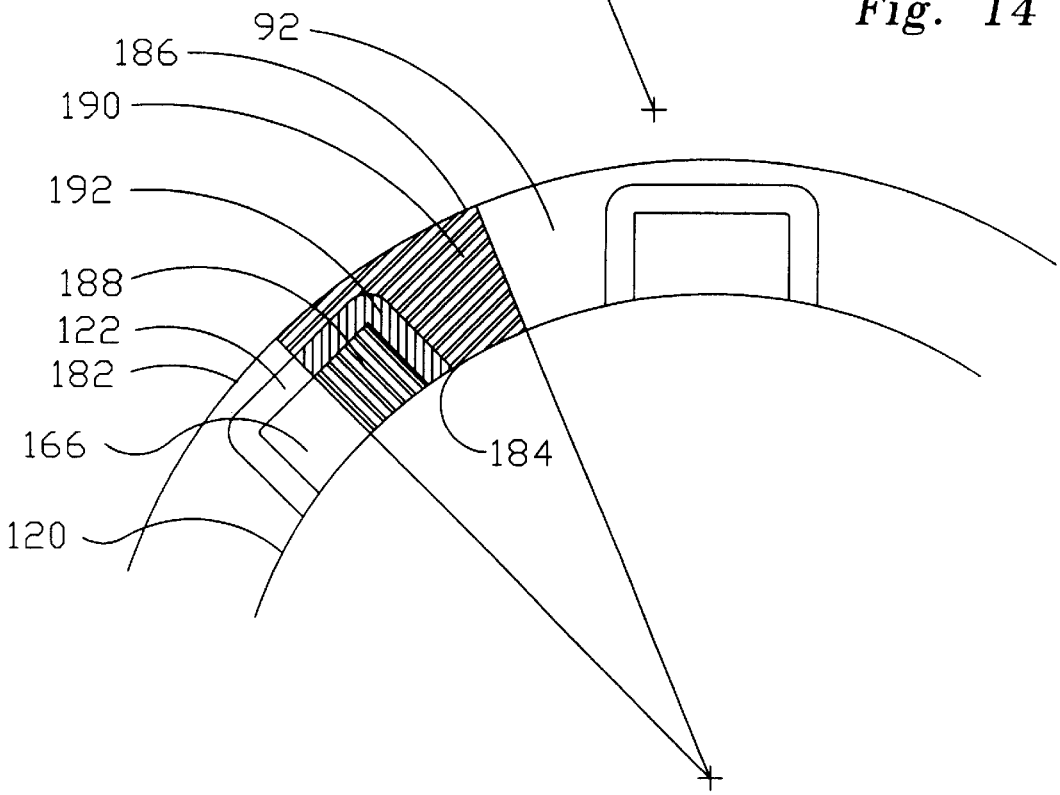

Referring to FIG. 14, during design of the channel elements 122, there are also two ratios of areas considered. In FIG. 14 the inside diameter 182 of the stretched pressure element 90 is illustrated. Typically the pressure element 90 is controlled to move radially outward by water pressure in flow passage 92, by about ⅛", to increase the flow rate through the flow passage 92 during the maximum injection mode. In this configuration, the flow area is between the inside diameter 182 of the pressure element 90 and the radius of curvature of the tooth portion 120, less the cross sectional area occupied by the channel elements 122. The sector of annulus (area bounded by two radii and the arcs 184, 186) is representative of the symmetry of "n" number of channel elements 122, and consists of three areas: the cross sectional area 192 of the channel elements 122 (which is ignored); the area 188 inside the channel elements; and the area 190 outside the channel elements 122. There are two area ratios: the inside area 188 of the channel elements 122, to the sum of the inside area 188 and the outside area 190 (188+190); and the outside area 190 to the sum of the inside area 188 and the outside area 190 (188+190). These two ratios should be on the order of 23% and 77% respectively.

These are empirical ratios determined through experimentation. These ratios have proven effective for the reinforcing layers used in the prototype pressure elements. Other ratios and models for channel element design may be developed at a later time without departing from the spirit of the invention.

Referring again to FIG. 8, the pressure element 90 includes the tube 126, the reinforcing layers 128, 130, and the cover 132, which are vulcanized to form a unitary structure. For a given inflation pressure on the pressure element 90 during the injection mode, the difference in pressure between the inflation pressure in the pressure passage 156, and the flow passage 92 will be smaller at the up hole end 48, and larger at the down hole end 46 of the valve 44. For a uniform gradient in pressure loss from the up hole end 48 of the valve 44, to the down hole end 46 of the valve 44, it is desirable for the pressure element 90 to have a higher stretch pressure at the down hole end 46 of the valve 44, than at the up hole end 48 of the valve 44. This is accomplished by having more reinforcing layers 128, 130 at the down hole end 46 of the valve 44. The additional reinforcing layers also help to keep the pressure element 90 from being dragged, or stretched, down to the down hole end 46 of the valve 44, which adversely affects pressure control.

In FIG. 8, note that the reinforcing layer 130 extends the entire length of the pressure element 90, and is secured by both the upper crimp collar 134, and the lower crimp collar 146. With a moderate modulus of elasticity, and placed at 0° to the longitudinal axis 94 (FIG. 3) of the pressure element 90, reinforcing layer 130 helps to keep the pressure element 90 from being stretched down to the down hole end 46 of the valve 44, while at the same time allowing for enough stretching to completely shut off flow in the shut off section 100 during the pumping mode. For longer pressure elements 90, having higher pressure losses through the valve 44, the reinforcing layer 130 may be divided into two sections, an up hole portion with reinforcing material having a high modulus of elasticity (such as steel), and a down hole portion with a reinforcing material having a low modulus of elasticity (such as a polyester cord). For larger flows, the region of reinforcing layer can comprise several plys: some with a full length, moderately elastic ply material; and some with a combination of low and high elastic ply material.

Still referring to FIG. 8, the reinforcing layer 128 must be at an angle to the longitudinal axis 94 (FIG. 3) in order to create a higher stretch pressure across the channel elements 122. The reinforcing layer 128 can be constructed in pairs, with a left hand lay and a right hand lay for adjacent plys as is conventional for prior art outwardly expanding inflatable packer elements. Typically, there can be a pair of plys for every ten inches of length in the orifice section 102. Accordingly, reinforcing layer 128 can represent 4 or 12 plys of reinforcing, as may be required for proper head loss. Subsequent pairs of plys can be ratioed along the length of the orifice section 102, increasing the stretch pressure into the areas between the channel elements 122 as the down hole end of the pressure element 90 is approached. The angles of these plys may typically range from 1° to 45°, although some applications may require higher angles without departing from the spirit of the invention. Note also that it is the angle, and modulus of elasticity of the reinforcing cord which influences the stretch pressure of the plys, as the plys stretch inwardly to reduce flow in the flow passage 92.

Figure 15:
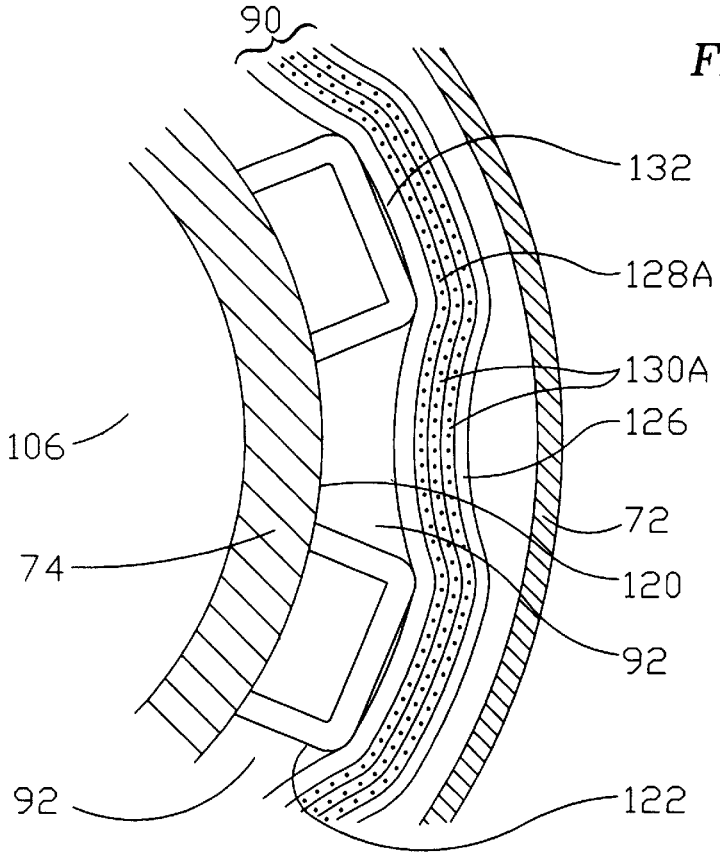
FIG. 15 is a schematic view illustrating the channel segments and the pressure element at a first inflation pressure.
Figure 16:
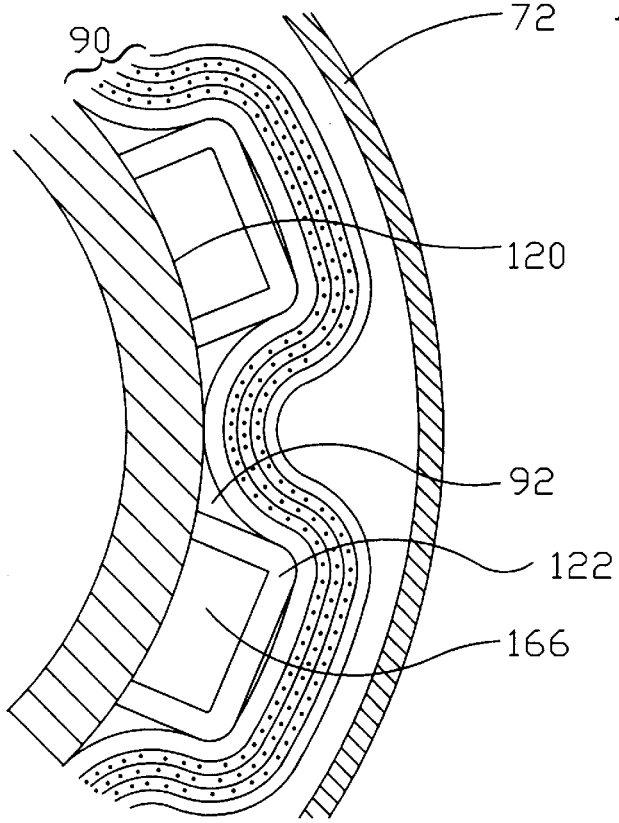
FIG. 16 is a schematic view illustrating the channel segments and the pressure element at a second inflation pressure.

Referring to FIG. 15, a cross section of the pressurized pressure element 90 including the cover 132, 0° reinforcing layer 128A, 35° reinforcing layer 130A formed as a pair of plys, and the tube 126, is shown reducing the flow area 92. FIG. 16 shows the pressure element 90 pressurized and closing off more of the flow passage 92 between the channel elements 122, as the pressure element 90 is pressed against the tooth portions 120 of the annular orifices 116. Note that the middle portions 166 of the channel elements 122 are still accessible for flow longitudinally, via a flow path denoted by the flow arrow 170 in FIG. 11, wherein the fluid flows circumferentially in the trough portions 118 (FIG. 11) of the annular orifices 116.

Figure 17:
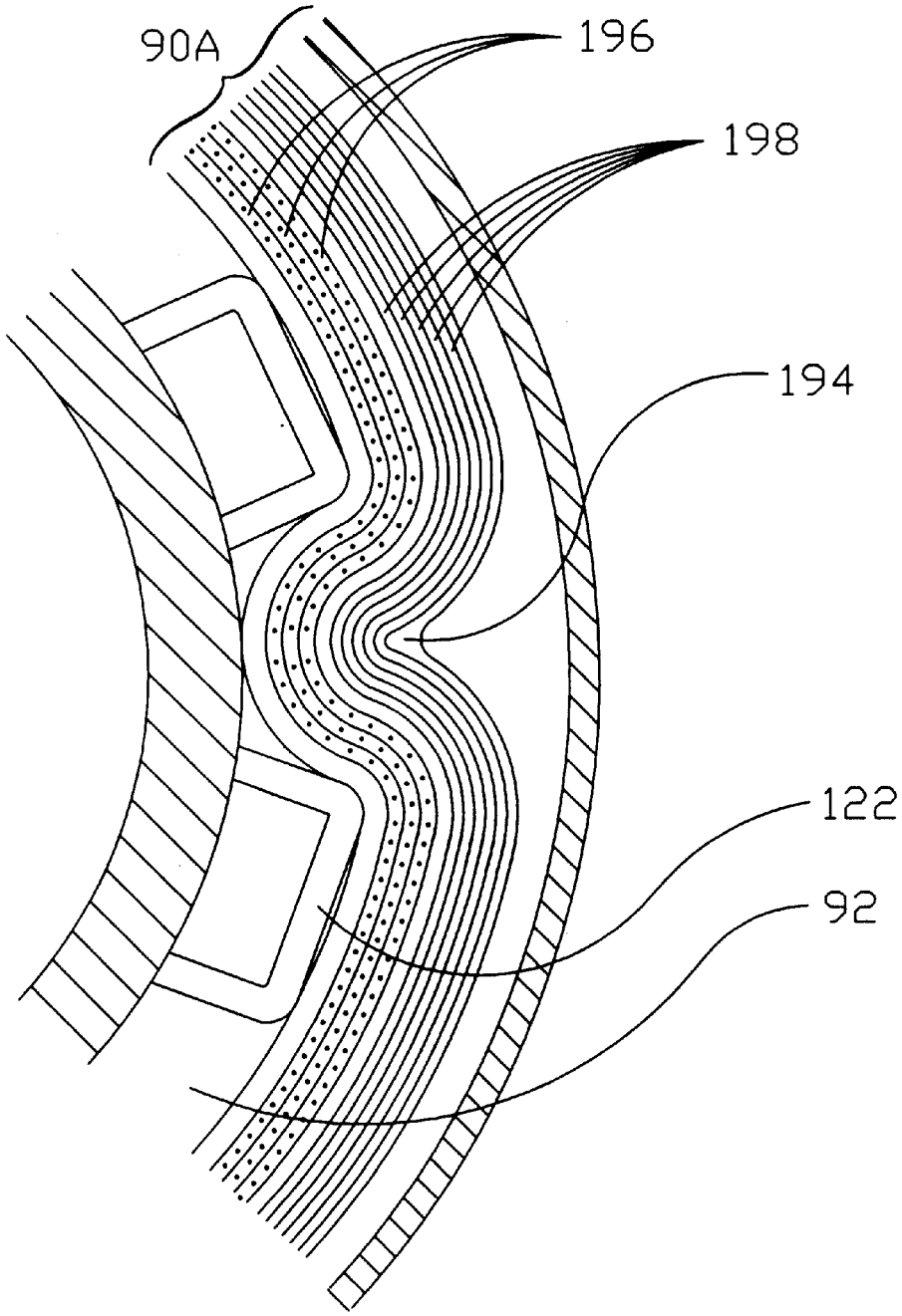
FIG. 17 is a schematic view equivalent to FIG. 12 illustrating an undesirable construction of the pressure element.

Referring to FIG. 17 a pressure element 90A having reinforcing layers 196 and rubber tube 198 being pinched at pinch point 194. This situation should always be avoided.

Another design consideration occurs during assembly of the valve 44. During the injection mode, the tortuous flow of the water provides the friction necessary for head loss in the orifice section 102 the valve 44. The tortuous flow includes flow over the tooth portions 120 of the annular orifices 116, as denoted by flow arrow 172 of FIG. 12. In addition, the tortuous flow includes circumferential flow, as denoted by flow arrow 170 of FIG. 11. Head loss is also produced by friction against the pressure element 90.

The friction against the pressure element 90 during the injection mode tends to drag the pressure element 90 down to the down hole end 46 of the valve 44. This can cause the pressure element 90 to close off the flow passage 92, which adversely affects flow control. This down hole dragging can be overcome by pre-tensioning the correctly designed pressure element 90 during assembly of the valve 44.

As shown in FIGS. 4A, and 4B, assembly of the valve 44 requires the pressure element 90 to be secured to the insert element 138 by attaching the upper barb 136, and the upper crimp collar 134, prior to attaching the lower barb 148, and the lower crimp collar 146. The lower barb 148, and lower crimp collar 146 is then attached to the spacer element 150 and mandrel 74 before securing the upper barb 136, upper crimp collar, and insert element 138 to the mandrel 74. This allows the pressure element 90 to be tensioned by pulling on the tension port 140 of the insert element 138 before forming circumferential weld 142. This pre-tensioning of the pressure element 90 helps to reduce dragging of the pressure element 90 to the down hole end 46 of the valve 44. Also, the lower barb 134 can be extended beyond the end of the lower crimp collar 146, towards the center of the pressure element 90, allowing some of the pressure element 90 to press into the area between the end of the lower barb 148, and the interface of the outer housing 72 and the lower crimp collar 146.

Thus the invention provides an improved control valve, an improved well system, and an improved method for injecting fluids into a well. While the invention has been described with reference to certain preferred embodiments, as will be apparent to those skilled in the art, certain changes and modifications can be made without departing from the scope of the invention as defined by the following claims.

What is claimed is:

1. A flow and pressure control valve comprising:

a tubular housing having a longitudinal axis;

an elongated tubular mandrel within the housing comprising an inside diameter and an outside diameter having a plurality of annular orifices formed thereon;

an annular flow passage within the housing along the outside diameter of the mandrel and in flow communication with the inside diameter of the mandrel;

a pressure element configured to move radially towards the longitudinal axis to vary a size of the flow passage; and a longitudinally extending tube in the housing proximate to the pressure element configured to equalize a fluid pressure along a length of the pressure element during pressurizing and de-pressurizing of the pressure element.

2. The control valve of claim 1 further comprising a plurality of channel elements on the outside diameter of the mandrel configured to provide a circumferential flow path through the flow passage.

3. The control valve of claim 1 wherein the annular orifices comprise circumferential grooves in the outside diameter.

4. The control valve of claim 1 wherein the pressure element is configured to seal fluid communication between the flow passage and the inside diameter of the mandrel for pumping fluid from a well to the inside diameter of the mandrel.

5. The control valve of claim 1 wherein the tube comprises a plurality of openings in flow communication with an inflation source.

6. A flow and pressure control valve comprising:

a tubular housing having a longitudinal axis;

an elongated tubular mandrel within the housing comprising an inside diameter, an outside diameter, a sidewall, a flow orifice through the sidewall in flow communication with the inside diameter, a plurality of annular orifices on the outside diameter, and a plurality of channel elements on the outside diameter;

a longitudinally extending annular flow passage within the housing located proximate to the annular orifices and the channel elements in flow communication with the flow orifice;

a pressure element configured to move radially towards the longitudinal axis upon application of an inflation pressure to vary an area of the flow passage; and a longitudinally extending tube within the housing configured to apply and equalize the inflation pressure applied to the pressure element.

7. The control valve of claim 6 further comprising a pressure chamber and a pressure passage within the housing in flow communication with the tube for pressurizing the pressure element.

8. The control valve of claim 6 wherein the pressure element comprises at least one elastomeric layer reinforced with a cord.

9. The control valve of claim 6 wherein the pressure element is configured for inflation to a pressure sufficient to seal the flow passage.

10. The control valve of claim 6 wherein the annular orifices comprise annular grooves in the sidewall configured to provide a tortuous flow path through the flow passage.

11. The control valve of claim 6 wherein the channel elements comprise u-shaped channels attached to the sidewall and configured to provide a circumferential and axial flow path through the flow passage.

12. A flow and pressure control valve comprising:

a housing;

a mandrel within the housing comprising an inside diameter configured for flow communication with a well, an outside diameter comprising a plurality of annular orifices, and a flow orifice from the inside diameter to the outside diameter;

an annular flow passage between the housing and the outside diameter of the mandrel in flow communication with the well and with the flow orifice in the mandrel;

a pressure element attached to the mandrel and configured for pressurization to first pressures for allowing a first fluid flow path through the inside diameter and flow orifice to the flow passage and to the well, or to a second pressure greater than the first pressures for sealing the flow orifice to permit a second fluid flow path from the well through the inside diameter of the mandrel; and a pressure passage between the housing and the pressure element for pressurizing the pressure element, and a vent tube within pressure passage comprising a plurality of openings for equalizing a pressure within the pressure passage.

13. The control valve of claim 12 further comprising a plurality of channel elements on the outside diameter of the mandrel configured to provide a circumferential flow path through the flow passage for the first fluid flow path.

14. The control valve of claim 12 further comprising a pressure chamber within the housing in flow communication with the pressure passage and the vent tube.

15. The control valve of claim 12 wherein the pressure element comprises at least one elastomeric layer reinforced with a cord.

16. A flow and pressure control valve comprising:

a housing;

a tubular mandrel within the housing having an outside diameter and an inside diameter configured for flow communication with a well and with a surface pipe;

a flow passage between the housing and the outside diameter of the mandrel in flow communication with a flow orifice in the mandrel to the inside diameter, and in flow communication with the well;

a plurality of annular orifices on the outside diameter of the mandrel within the flow passage;

a plurality of longitudinally extending channel segments on the outside diameter of the mandrel within the flow passage; and a pressure element within the flow passage configured for movement towards the outside diameter of the mandrel, configured for pressurization in a pumping mode of the valve to seal the flow passage and permit a first fluid flow path from the well through the mandrel to the surface pipe, and configured for pressurization in an injection mode to permit a second fluid flow path from the mandrel through the flow orifice and the flow passage to the well.

17. The control valve of claim 16 further comprising a tube in the housing proximate to the pressure element configured to equalize a fluid pressure along a length of the pressure element.

18. The control valve of claim 16 wherein the pressure element has different stretch pressures at a down hole end of the valve and at an up hole end of the valve.

19. The control valve of claim 16 wherein the pressure element comprises a first reinforcing layer proximate to an uphole end of the valve comprising a first reinforcing material and a second reinforcing layer proximate to a downhole end of the valve comprising a second reinforcing material.

20. The control valve of claim 16 wherein the pressure element comprises a first reinforcing layer proximate to an uphole end of the valve comprising a first reinforcing material having a first modulus of elasticity, and a second reinforcing layer proximate to a downhole end of the valve comprising a second reinforcing material having a second modulus of elasticity.

21. A control valve for injecting fluid into a well a well comprising:

a housing placed within the well;

an elongated tubular mandrel within the housing comprising an inside diameter, an outside diameter, a sidewall, a flow orifice through the sidewall in flow communication with the inside diameter, a plurality of annular orifices on the outside diameter, and a plurality of channel elements on the outside diameter;

a longitudinally extending annular flow passage within the housing located proximate to the annular orifices and the channel elements in flow communication with the flow orifice;

a pressure element configured to move into the flow passage to vary an area of the flow passage during injection of a fluid into the well, or to seal the flow passage during pumping of the fluid from the well;

a pressure chamber in the housing configured to apply an inflation pressure to pressurize the pressure element; and an inflation passage and a tube in the inflation passage comprising a plurality of openings in flow communication with the pressure chamber configured to equalize the inflation pressure along a length of the pressure element.

22. The control valve of claim 21 wherein the well comprises a recharge/pumping water well.

23. The control valve of claim 21 further comprising a pressure source in flow communication with the pressure chamber, with the inflation passage and with the tube.

24. The control valve of claim 21 wherein the pressure chamber is in flow communication with a gas pressure source configured to vary a fluid pressure of the inflation pressure.

25. A method for injecting a fluid into a well comprising:

providing a control valve comprising:

a tubular housing in flow communication with the well;

an elongated tubular mandrel within the housing comprising an inside diameter and an outside diameter having a plurality of annular orifices formed thereon;

an annular flow passage within the housing along the outside diameter of the mandrel and in flow communication with the inside diameter of the mandrel;

a pressure element configured to move radially towards a longitudinal axis of the valve to vary a size of the flow passage; and an elongated tube in the housing proximate to the pressure element comprising a plurality of openings configured to apply a pressure to the pressure element;

injecting the fluid into the flow passage with the annular orifices providing a tortuous flow path and a frictional pressure loss to prevent cavitation and cascading of the fluid; and applying the pressure through the tube and the openings to the pressure element to vary the frictional pressure loss and to equalize the pressure along the pressure element.

26. The method of claim 25 further comprising sealing the flow passage by pressurizing the pressure element and pumping the fluid from the well through the mandrel to a surface pipe.

* * * * *